US006955440B2

(12) United States Patent
Niskanen

(10) Patent No.: US 6,955,440 B2
(45) Date of Patent: Oct. 18, 2005

(54) DECORATIVE LIGHT DEFUSING NOVELTY LAMP

(76) Inventor: Will Niskanen, 2005 California St. NE., Studio 411, Minneapolis, MN (US) 55418

( * ) Notice: Subject to any disclaimer, the term of this patent is extended or adjusted under 35 U.S.C. 154(b) by 0 days.

(21) Appl. No.: 10/641,669

(22) Filed: Aug. 15, 2003

(65) Prior Publication Data

US 2005/0036317 A1 Feb. 17, 2005

(51) Int. Cl.[7] ..... F21V 33/00

(52) U.S. Cl. ..... 362/96; 362/253; 362/294; 362/352; 362/373; 362/396

(58) Field of Search ..... 362/96, 253, 294, 362/352, 373, 396, 806

(56) References Cited

U.S. PATENT DOCUMENTS 1,824,388 A * 9/1931 Serge ..... 40/439
4,962,687 A * 10/1990 Belliveau et al. ..... 84/464 R
6,428,185 B1 * 8/2002 Lin ..... 362/253
6,454,425 B1 * 9/2002 Lin ..... 362/96
2003/0031009 A1 * 2/2003 Fan ..... 362/96

* cited by examiner

*Primary Examiner*—John Anthony Ward
*Assistant Examiner*—Mark Tsidulko
(74) *Attorney, Agent, or Firm*—Thrasher Associates

(57) ABSTRACT

The invention provides a decorative light-defusing novelty lamp. The novelty lamp includes a housing, a tube coupled to the housing, a fan rigidly disposed in the housing and adapted to draw air into the housing and through the tube. In addition, the invention has a light means mounted substantially within the housing which is adapted to cast light into the tube, and a light defusing member adapted to defuse light within the tube.

19 Claims, 2 Drawing Sheets

FIG. 2
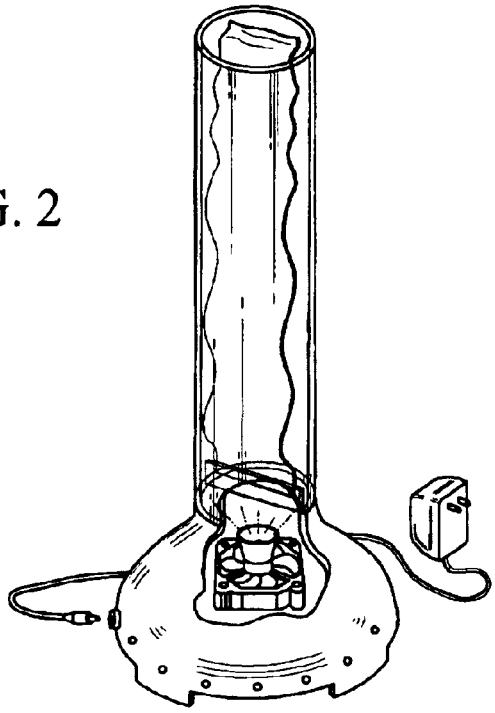
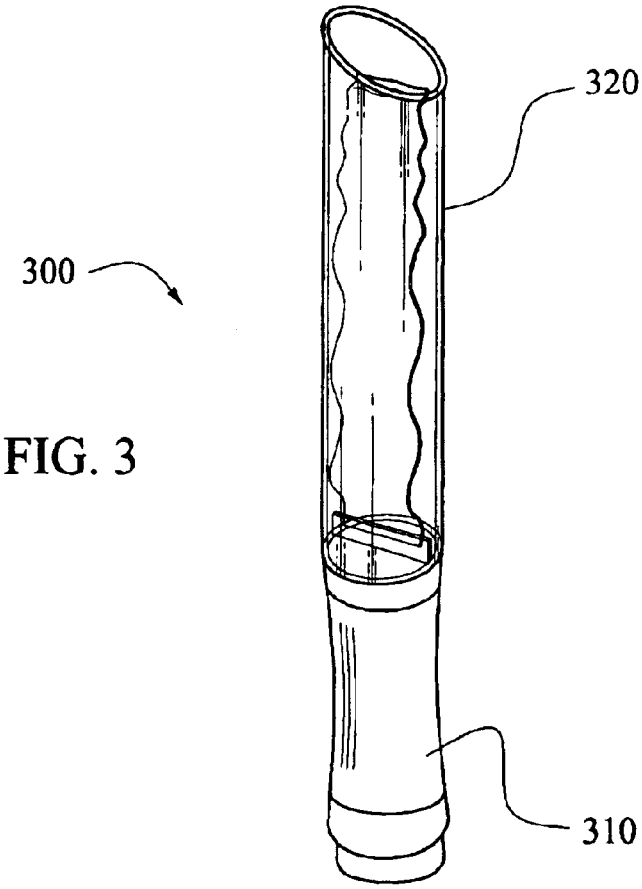
FIG. 3

DECORATIVE LIGHT DEFUSING NOVELTY LAMP

TECHNICAL FIELD

In general, the invention relates to novelty lamps. More particularly, the invention relates to novelty lamps that do not use liquid to defuse light.

STATEMENT OF A PROBLEM ADDRESSED BY THE INVENTION

Interpretation Considerations

This section describes the technical field in more detail, and discusses problems encountered in the technical field. This section does not describe prior art as defined for purposes of anticipation or obviousness under 35 U.S.C. section 102 or 35 U.S.C. section 103. Thus, nothing stated in the Statement of a Problem Addressed by This Invention is to be construed as prior art.

Discussion

Novelty lamps have been used for years to provide entertainment and relaxation to persons throughout the world. For example, many persons are familiar with lava lamps, which, by heating blobs of material, induce the material to change buoyancy and thus float and sink within a liquid bath. Sometimes, the blobs are colored. Sometimes, the blobs may have different colors. The appearance of the floating and sinking globs may be further enhanced by the casting of light upon the blobs. In any event, novelty lamps such as lava lamps often induce dangers to the environment.

For example, the heating plates used to warm blobs may overheat and cause the lamp to melt which could in turn cause a fire or at the very least water damage to the surrounding area. Similarly, the lava lamps themselves may leak and cause water damage to the surrounding area and likewise when the liquid within a lava lamp leaks out the burning plate of the lava may then cause a fire. Other novelty lamps suffer from similar drawbacks. Accordingly, it is desirous to provide a novelty lamp that is both entertaining, relaxing, and avoids dangers and inconveniences associated with liquid maintaining novelty lamps. The present invention provides such a system and device.

BRIEF DESCRIPTION OF THE DRAWINGS

Various aspects of the invention, as well as at least one embodiment, are better understood by reference to the following EXEMPLARY EMBODIMENT OF A BEST MODE. To better understand the invention, the EXEMPLARY EMBODIMENT OF A BEST MODE should be read in conjunction with the drawings.

FIG. 2 illustrates a cut-view of the inventive lamp of FIG. 1.

FIG. 3 provides an alternative embodiment of a decorative base.

AN EXEMPLARY EMBODIMENT OF A BEST MODE

Interpretation Considerations

Figure 1:
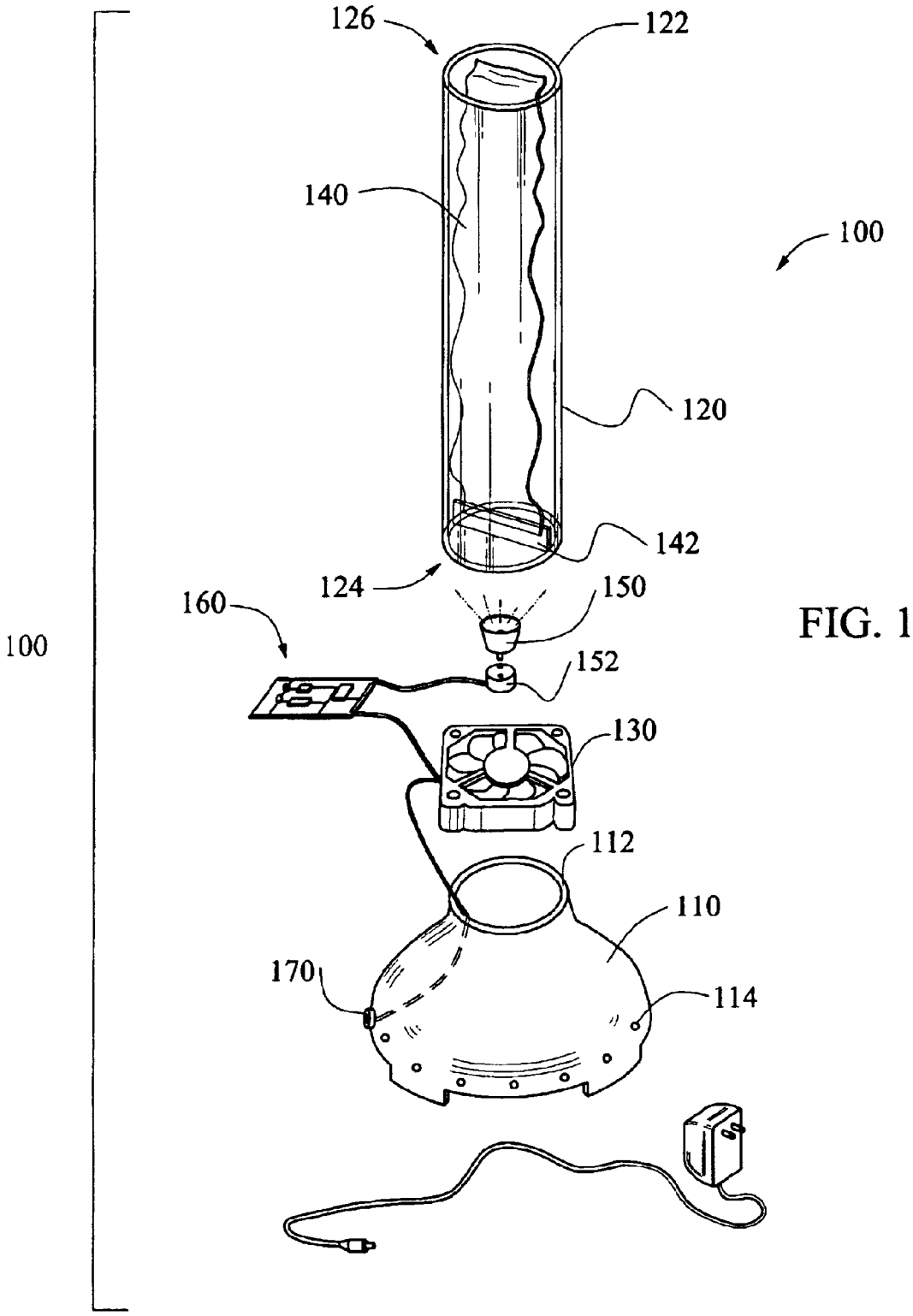
FIG. 1 is a diagram of an inventive novelty lamp.

When reading this section (An Exemplary Embodiment of a Best Mode, which describes an exemplary embodiment of the best mode of the invention, hereinafter "exemplary embodiment"), one should keep in mind several points. First, the following exemplary embodiment is what the inventor believes to be the best mode for practicing the invention at the time this patent was filed. Thus, since one of ordinary skill in the art may recognize from the following exemplary embodiment that substantially equivalent structures or substantially equivalent acts may be used to achieve the same results in exactly the same way, or to achieve the same results in a not dissimilar way, the following exemplary embodiment should not be interpreted as limiting the invention to one embodiment.

Likewise, individual aspects (sometimes called species) of the invention are provided as examples, and, accordingly, one of ordinary skill in the art may recognize from a following exemplary structure (or a following exemplary act) that a substantially equivalent structure or substantially equivalent act may be used to either achieve the same results in substantially the same way, or to achieve the same results in a not dissimilar way.

Accordingly, the discussion of a species (or a specific item) invokes the genus (the class of items) to which that species belongs as well as related species in that genus. Likewise, the recitation of a genus invokes the species known in the art. Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated (for example, one recognizes that "tacking" may be done by nailing, stapling, gluing, hot gunning, riveting, etc., and so a use of the word tacking invokes stapling, gluing, etc., and all other modes of that word and similar words, such as "attaching"). Fourth, unless explicitly stated otherwise, conjunctive words (such as "or", "and", "including", or "comprising" for example) should be interpreted in the inclusive, not the exclusive, sense. Fifth, the words "means" and "step" are provided to facilitate the reader's understanding of the invention and do not mean "means" or "step" as defined in §112, paragraph 6 of 35 U.S.C., unless used as "means for—functioning—" or "step for—functioning—" in the Claims section.

Discussion of the Figures

FIG. 1 is a diagram of an inventive light defusing novelty lamp (novelty lamp) 100. The novelty lamp 100 generally includes a housing having an orifice 112 and at least one air passage 114 to accommodate an airflow. The housing 110 is preferably configured to rest on a flat surface, and may be decorative. One exemplary decorative base is clear, while other decorative bases may be colored, opaque, and may have school mascots/logos embossed thereon.

The novelty lamp includes a tube 120 coupled to the orifice. The tube is adapted to allow air to flow from the orifice and through the tube, and is preferably has an exterior diameter 122 that is slightly narrower than the interior diameter of the orifice 112. The tube 120 can be clear, opaque, colored, and may include a novelty mascot and university or school features/colors thereon. Additionally, the housing 110 is preferably adapted to hold the tube 120 vertically upright when the housing 110 is placed on a flat surface.

The invention further includes a light defusing member 140 adapted to diffuse light within the tube 120, coupled to at least a first end 124 of the tube, but may also be coupled to second end of the tube as well. In a preferred embodiment, the light-diffusing member 140 is attached to a first bracket 142 which is coupled to the first end 124 of the tube. Of course, the light-diffusing member may also be coupled to a second bracket (not shown) coupled to the second end of the tube. Accordingly, in an alternative embodiment the novelty lamp 100 tube 120 may include a first bracket 142 coupled to a first end 124 of the tube and a second bracket coupled to a second end 126 of the tube. In this embodiment, the light defusing member 140 is coupled to the first bracket 142 and the second bracket.

The light-diffusing member 140 is preferably an rectangular strip, which may be an elongated rectangular strip, of opaque material, but may comprise strips, strip(s) with holes, a single strip with "tears" or cuts, or other shapes that add to the visual appeal of the novelty lamp 100. The light diffusing member 140 may be twisted, or threaded about any number of objects within a tube. The light defusing member 140 may include a cloth strip, a paper strip, and may comprise silk. Further, the light-diffusing member 140 may be clear, opaque, transparent, translucent, "solid" or colored, and may include images of school mascots or school colors. Further, the light diffusing member 140 may spin or undulate as a either a fabric or a solid piece of material. The light diffusing member 140, however, preferably does not take the appearance of a flame.

The novelty lamp 100 also includes a fan 130 rigidly disposed substantially in the housing 110. The fan 130 adapted to draw air into the housing 110 and through the tube 120. The fan 130 is preferably a DC motor fan, such as the type common in computer housings.

A light means 150 is mounted substantially within the housing 110 on a light means mount 152. A light means is any type of light-producing device adapted to cast light into the tube 120. In one embodiment, the light means 150 is a standard vacuum-tube light that could be clear or colored, and could be a colored novelty light, such as a Christmas-tree type light. Similarly, the light means 150 could comprise a Light Emitting Diode (LED) or LEDs, which could also be clear or colored.

In an alternative embodiment, the novelty lamp 100 includes a control circuit 160 coupled to at least the first light means 150. Accordingly, the control circuit can control the intensity of the light means 150, or can create an alternating sequence of colors by delivering power in predetermined sequences to a plurality of light means. For example, the control circuit 160 could alternate power delivery between a first light means and a second light means to transition from one school color to a second school color. The invention also can be said to include a power source plug 170 adapted to transfer power to the motor 130 and the light means 150.

FIG. 2 illustrates a cut-view of the inventive lamp of FIG. 1. This view features the attractive appearance of the novelty lamp 100 when assembled.

FIG. 3 provides an alternative embodiment of a novelty lamp 300 having a decorative base 310. In one embodiment, the housing 310 has the appearance of a sword handle. To add portable functionality to the novelty lamp 300, housing is adapted to support a battery therein (the use of a battery to supply to DC power to a light is known in the electrical arts, though unknown in the arts of novelty lighting).

Thus, though the invention has been described with respect to a specific preferred embodiment, many variations and modifications will become apparent to those skilled in the art upon reading the present application. It is therefore the intention that the appended claims be interpreted as broadly as possible in view of the prior art to include all such variations and modifications.

Further, other features and embodiments of the invention will be apparent to those of ordinary skill in the art. After reading this specification, including the Exemplary Embodiment, these persons will recognize that similar results can be achieved in not dissimilar ways. Accordingly, the Exemplary Embodiment is provided as an example of the best mode of the invention, and it should be understood that the invention is not limited by it, but, rather, the invention should be read as being limited only by the claims.

I claim:

1. A decorative light diffusing novelty lamp comprising:

a housing having an orifice and at least one air passage to accommodate an airflow;

a tube coupled to the orifice, the tube adapted to allow air to flow from the orifice and through the tube;

a fan rigidly disposed substantially in the housing and underneath an opaque light diffusing member, the fan adapted to draw air into the housing and through the tube;

a light means mounted substantially within the housing, the light means adapted to cast light into the tube; and the light diffusing member adapted to diffuse light within the tube, the light diffusing member maintained inside the housing and tube.

2. The lamp of claim 1 wherein the housing has the appearance of a sword handle.

3. The lamp of claim 1 wherein the tube is clear.

4. The lamp of claim 1 wherein the tube is opaque.

5. The lamp of claim 1 wherein the tube is colored.

6. The lamp of claim 1 further comprising a power source plug adapted to transfer power to the motor and the light.

7. The lamp of claim 1 wherein the light means comprises a Light Emitting Diode (LED).

8. The lamp of claim 7 wherein the light means comprises a second LED.

9. The lamp of claim 1 further comprising a control circuit coupled to at least the first light means.

10. The lamp of claim 9 wherein the control circuit alternates power delivery between a first light means and a second light means.

11. The lamp of claim 1 wherein the housing is adapted to support a battery therein.

12. The lamp of claim 1 wherein the housing is adapted to hold the tube vertically upright when the housing is placed on a flat surface.

13. The lamp of claim 1 wherein the lamp of claim 1 wherein the light diffusing member is a cloth strip.

14. The lamp of claim 1 wherein the light defusing member is a strip of cloth comprising silk.

15. The lamp of claim 1 wherein the light defusing member is coupled to the tube.

16. The lamp of claim 1 wherein the light defusing member is coupled to a first end of the tube and a second end of the tube.

17. The lamp of claim 1 wherein the tube comprises a first bracket at a first end of the tube.

18. The lamp of claim 17 wherein the light defusing member is coupled to the bracket.

19. A decorative light diffusing novelty lamp comprising:

a housing having an orifice and at least one air passage to accommodate an airflow;

a tube coupled to the orifice, the tube adapted to allow air to flow from the orifice and through the tube;

a fan rigidly disposed substantially in the housing, the fan adapted to draw air into the housing and through the tube;

a light means mounted substantially within the housing, the light means adapted to cast light into the tube; and the light diffusing member adapted to diffuse light within the tube, wherein the tube comprises a first bracket coupled to a first end of the tube and a second bracket coupled to a second end of the tube, the light defusing member is coupled to the first bracket and the second bracket.

* * * * *